US008844444B1

(12) United States Patent
Hooke et al.

(10) Patent No.: US 8,844,444 B1
(45) Date of Patent: Sep. 30, 2014

(54) REUSABLE TEST PROJECTILE

(71) Applicant: The United States of America as represented by the Secretary of the Army, Dover, NJ (US)

(72) Inventors: Ryan Hooke, Hopatcong, NJ (US); Tyler Myers, Hopatcong, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/887,605

(22) Filed: May 6, 2013

Related U.S. Application Data

(63) Continuation-in-part of application No. 12/874,405, filed on Sep. 2, 2010, now abandoned.

(51) Int. Cl.
*F42B 8/00* (2006.01)

(52) U.S. Cl.
USPC ..... 102/502; 102/473; 102/498; 102/524

(58) Field of Classification Search
USPC ..... 102/473, 489, 498, 501, 502, 524, 526, 102/527, 528, 529
See application file for complete search history.

(56) References Cited

U.S. PATENT DOCUMENTS 4,242,961 A * 1/1981 Moredock et al. ..... 102/527
4,600,421 A * 7/1986 Kummann ..... 62/621
4,771,696 A * 9/1988 Smolnik ..... 102/473
5,233,127 A * 8/1993 Sauvestre et al. ..... 102/489
5,682,011 A * 10/1997 Sabranski et al. ..... 102/527
6,401,622 B1 * 6/2002 Brinkmann ..... 102/524
2012/0017795 A1 * 1/2012 Dryer et al. ..... 102/526

OTHER PUBLICATIONS

M483, 155-mm Howitzer Shell. Jul. 9, 2008. <http://web.archive.org/web/20030310102257/http://www.globalsecurity.org/military/systems/munitions/m483.htm> and <http://web.archive.org/web/20080709083435/http://www.globalsecurity.org/military/systems/munitions/m483.htm>.*

* cited by examiner

*Primary Examiner* — Gabriel Klein

(74) *Attorney, Agent, or Firm* — Michael C. Sacks; Henry S Goldfine

(57) ABSTRACT

A reusable test projectile may be used for spinning and non-spinning shots in a soft catch system. The projectile may include a body having an integrally formed base and a removable nose. The body may define a generally cylindrical open area between the nose and the base. A generally circular cargo retaining ring may be disposed in the open area, normal to a longitudinal axis of the projectile. A cargo area is defined between the cargo retaining ring and the base. The solid bulkhead includes a front surface that forms a rear end of the cargo area and a rear concave surface. A driving band seat can be added on the exterior surface of the body at the bulkhead, for each repeated launch of the projectile, as may be desired. A slipped obturator seat may be formed on the exterior surface of the base rearward of the driving band seat, as desired.

12 Claims, 7 Drawing Sheets

REUSABLE TEST PROJECTILE

CROSS REFERENCE TO RELATED APPLICATION

This application is a continuation in part of commonly assigned application Ser. No. 12/874,405 filed Sep. 2, 2010 by the same inventors, entitled "Reusable Test Projectile".

STATEMENT OF GOVERNMENT INTEREST

The inventions described herein may be manufactured, used and licensed by or for the U.S. Government for U.S. Government purposes.

BACKGROUND OF THE INVENTION

The invention relates, in general, to munitions, and, in particular, to test projectiles.

Collateral damage caused by munitions is a problem. There is a need for precision munitions that may reduce collateral damage. This need has been present for years and will continue into the future due to the nature of many modern-day battlefields.

Projectiles may be stabilized in flight by spinning the projectile or by using fins on the projectile. A spin stabilized round or projectile may attain flight stability due to an interference fit between a metallic driving band mechanically attached to the projectile and the lands and grooves (rifling) in the launching tube. The interference between the metallic driving band and the rifling in the tube may also seal the propellant gases behind the driving band. As the projectile travels down the launching tube, the twist of the rifling in the tube may impart rotational motion to the projectile through the band. Thus, the projectile may exit the tube with spin, which may help stabilize the projectile in flight. A spinning projectile may have a spin rate of about 200 hertz or more.

Many of today's precision munitions may be fin stabilized. When shot from cannon, a fin stabilized projectile may seal the propellant gas behind it to produce the pressure needed to propel the projectile out of the cannon tube. A slipped obturator may be used to seal the gas behind the projectile. The slipped obturator may seal propellant gases behind it much like a piston ring in an internal combustion engine. The slipped obturator may be placed near the rear of the projectile. The slipped obturator may cause an interference fit between the rifling in the launching tube and the projectile.

Unlike the metallic driving band, however, the slipped obturator may not be mechanically coupled to the projectile body in the radial direction. As the projectile travels down the launching tube, the rifling may cause the slipped obturator to spin. The interference between the slipped obturator and the tube wall may seal the propellant gases. But, because the projectile is decoupled from the slipped obturator, the projectile may not spin at the same rate as the slipped obturator or induce the magnitude of spin of a metallic driving band. The reduction in spin from the slipped obturator to the projectile may be needed for proper functioning of some guidance and navigation systems that are part of a precision guided munition.

The projectile with the slipped obturator may have a spin rate of about 0 hertz to about 80 hertz, for example. The spin rate of a projectile with a slipped obturator is much less than the spin rate of a projectile with a driving band. As used in the specification and claims, and as known in the art, a "non-spinning" projectile or round with a slipped obturator may have some small amount of spin, but that amount of spin is very much less than the spin of a "spinning" projectile with a driving band.

The guidance and navigation systems in precision munitions may be very expensive. This expense, coupled with the desire to increase the range of precision munitions, has created a need to test projectiles at extreme loads. The same statistical inference may be obtained at a lower cost by testing a projectile a fewer number of times, near the upper bounds of its operating conditions (i.e., Permissible Maximum Pressure (PMP)+25% above normal), than by testing a projectile a greater number of times, at only a small amount above its normal operating conditions (i.e., PMP+5% above normal).

The guidance and navigation systems of a projectile may need to be tested at the upper bounds of a projectile's operating conditions. Also, it is necessary to determine if the failure may occur at gun launch or at projectile impact. Methods of catching a projectile that stop the projectile's forward movement without damaging the projectile are known. These "soft catch" methods include the rail gun and the soft catch recovery system along with shooting into impact areas amenable to the preservation of the projectile. The rail gun simply shoots the projectile into a closed rail system that has a water medium to slow the projectile down. The soft catch recovery system goes one step further and uses a mass/spring damper of air and water in series to better control deceleration of the projectile. The soft catch recovery system may produce more accurate data with less balloting of the projectile and a slower de-acceleration rate.

SUMMARY OF THE INVENTION

It is object of the invention to provide a reusable test projectile that may be fired as a spinning projectile or as a non-spinning projectile combing the necessary attributes of both.

It is another object of the invention to provide a reusable test projectile that may be fired repeatedly as a spinning projectile or as a non-spinning projectile.

It is a further object of the invention to provide a reusable test projectile that may be alternately fired as a spinning projectile and as a non-spinning projectile.

One aspect of the invention is a reusable test projectile. The reusable test projectile may include a body having an integrally formed base and a removable nose. The body may define a generally cylindrical open area between the nose and the base. The body may be made of a high strength steel alloy. A cargo area may be defined between the nose and the base.

The projectile may include a solid bulkhead having a front surface that forms a rear end of the cargo area and a rear concave surface that defines a cup. A keyway may be defined in the inner surface of the body in the cargo area. A driving band seat may be included on an exterior surface of the body at an axial location of the bulkhead. The outside diameter of the body may decrease at a front end of the driving band seat and then increase at a rear end of the driving band seat.

A slipped obturator seat may be disposed on the exterior surface of the body rearward of the driving band seat. The outside diameter of the body may decrease at a front end of the slipped obturator seat. The exterior surface of the body from the rear of the nose to the front end of the driving band seat may be free of discontinuities including bourrelets.

The projectile may include a generally circular cargo retaining ring containing torque features disposed in the open area and normal to a longitudinal axis of the projectile. An outer surface of the cargo retaining ring may engage an inner surface of the body utilizing extra fine thread engagement for increase thread strength. The cargo retaining ring may be adjustable in an axial direction to compress a compressible cargo or very the pre-load on the cargo.

In one embodiment of the projectile, a metal driving band may be fixed to the driving band seat. In another embodiment of the projectile, a slipped obturator may be disposed at the slipped obturator seat and a slipped obturator retaining ring may be removably fixed to a rear end of the base.

Another aspect of the invention is a method. The method may include providing a projectile, launching the projectile, and recovering the projectile with a soft catch system.

Providing the projectile may include providing the projectile with a metal driving band fixed to the driving band seat. Launching may include launching the projectile through a band cutter that strips the metal driving band from the projectile. The method may further include, after recovering the projectile, fixing a second metal driving band to the driving band seat. The method may further have a mechanically coupled driving band which will spate from centrifugal forces upon muzzle exit without the need of a band cutter.

The method may further include, after recovering the projectile, placing a slipped obturator in the slipped obturator seat and fixing a slipped obturator retaining ring to a rear end of the base. After fixing the slipped obturator retaining ring, the method may include launching the projectile again and recovering the projectile again with a soft catch system.

After recovering the projectile again, the method may include removing the slipped obturator retaining ring and the slipped obturator, and then, fixing a second metal driving band to the driving band seat.

Providing the projectile may include providing the projectile with a slipped obturator in the slipped obturator seat and a slipped obturator retaining ring removably fixed to a rear end of the base. After recovering the projectile, the method may include removing the slipped obturator retaining ring and the slipped obturator, and then, fixing a metal driving band to the driving band seat.

Providing the projectile may include providing the projectile with a slipped obturator in the slipped obturator seat, absent a metallic driving band and a fined projectile base removably fixed to the rear of the base to ballistically stabilize the projectile upon muzzle exit when not fired in a containment soft catch system.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Methods of Making a Projectile

Figure 1:
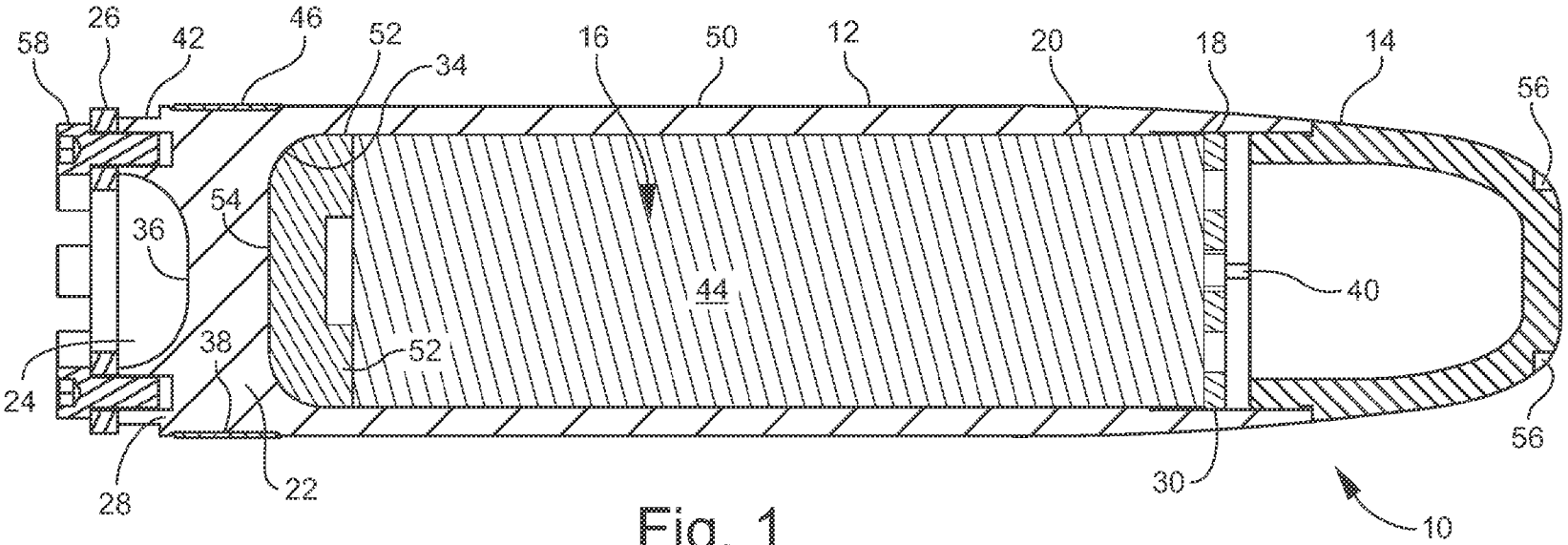
FIG. 1 is a side sectional view of an embodiment of a reusable test projectile.

The RTP may be manufactured using a material that is tough and strong, for withstanding extreme testing conditions, for example, high-strength steel. During the forging process, the steel blank may be drawn into an elongated cup. The blank may re-enter the production line where it may be rough machined, heat treated, fitted with a driving band, final machined, painted, marked, and shipped. Existing quality control processes may be used to ensure safety critical items standards are met and high quality end products are produced, as defined by military standards already in place. Unlike conventional munitions made on the same production line; unique steel chemistry, forging parameters, heat treatment and tolerances will be controlled to produce the desired high strength/high performance test projectile. The tooling, material flow and inspection process allow for a reduction in cost compared to other ways of manufacturing high strength/high performance test projectiles.

A Reusable Test Projectile and Methods of Use

The RTP may be used to test its cargo or projectile components attached to a RTP. In a carrier configuration projectile components may include fuzes, guidance and navigation assemblies/units, fin stabilizing bases, base bleeds or rocket motors. The cargo carried by the RTP may be, for example, instrumentation that may be for use in the navigation and control system of a guided projectile. The instrumentation may be placed in the RTP to test the survivability of the instrumentation under harsh launch conditions, and not for navigation and control of the RTP itself. When loaded as cargo in the RTP, the instrumentation may experience conditions that simulate the conditions that the instrumentation would experience if the instrumentation were launched in the guided projectile for which the instrumentation was designed.

The RTP will preferably be used with a soft catch system so that, when the RTP comes to rest, the RTP cargo (instrumentation, for example) may be removed and analyzed for damage or degradation of performance. And, the RTP may be reused. Also, the RTP may be configured for either spinning or non-spinning flight.

The RTP may isolate its cargo from exterior loading. A cargo retaining ring in the RTP may help isolate the cargo from exterior loading. A cargo retaining ring in the RTP may pre-load the cargo to thereby dampen unnatural ringing. So, the RTP cargo may be only subjected to its own inertial loading.

The RTP may isolate its cargo from external loads, and the body walls of the RTP may not be subjected to loads applied by its internal cargo. Thus, the RTP may be able to support external cargo, such as, for example, an on-board recorder placed at the nose of the RTP, fuzes, Guidance and Navigation Units or other attached projectile components. The inertia and/or weight of the external cargo may be applied to the body walls of the RTP, rather than to the RTP's cargo, e.g.

In the RTP, the cargo experiences loads close to those of a tactical projectile (that is, a projectile wherein the RTP cargo is performing its design function as part of the navigation system). Thus, tactical projectile loads may be applied to the RTP cargo, and the walls of the RTP may be independently loaded with the weight of the ogive. The internal cargo capacity of the RTP may be great therefore.

The RTP does not require shims for pre-loading the cargo. The cargo may be placed in the RTP cargo area and torqued down to the desired pre-load using the cargo retaining ring. Use of the cargo retaining ring may reduce the pre-load deviation from shot to shot. Use of the cargo retaining ring may reduce unnatural ringing in the cargo.

Because the RTP is fired into a soft catch system, the RTP may experience forces that may be different than "real" gun launch environments. The adjustable cargo retaining ring is helpful for simulating "real life" projectile dynamics. In addition, the dimensional tolerance between the cargo and the interior body wall may be more exact in the RTP. For example, the inside diameter of the RTP body in the cargo area may have a tolerance of plus or minus 0.005 inches. A sliding fit between the cargo and the RTP body helps prevent radial movement of the cargo (balloting) within the RTP.

FIG. 1 is a side sectional view of an embodiment of a reusable test projectile (RTP) 10. RTP 10 may include a body 12 having an integrally formed base 28 and a removable ogive or nose 14. Body 12 may define a generally cylindrical open area between nose 14 and base 28. Body 12 may be made of a high strength steel alloy. The high strength steel alloy may have a yield strength of, for example, about 190-205 ksi. The alloy may be, for example, 4340, maraging, or Eglin steel.

Figure 2:
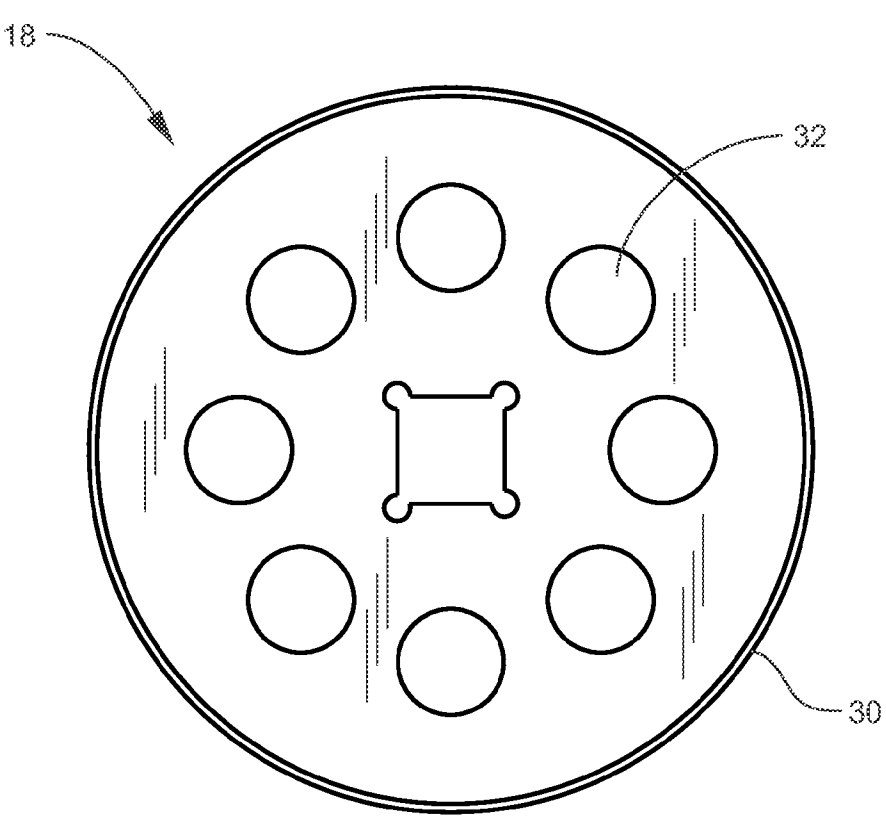
FIG. 2 is a front view of an embodiment of a cargo retaining ring for a reusable test projectile.

A generally circular cargo retaining ring 18 (FIGS. 1 and 2) may be disposed in the open area between nose 14 and base 28. Ring 18 may be disposed normal to a longitudinal axis A of RTP 10. An outer surface 30 of cargo retaining ring 18 may engage an inner surface 20 of body 12. Outer surface 30 of ring 18 and inner surface 20 of body 12 may be engaged using, for example, threads formed on outer surface 30 and inner surface 20. Cargo retaining ring 18 may be adjustable in the axial (A) direction. Openings 32 (FIG. 2) may be formed in cargo retaining ring 18 for weight reduction, communication channels and as torque features.

A cargo area 16 (FIG. 1) may be defined between cargo retaining ring 18 and base 28. A solid bulkhead 22 may include a front surface 34 that forms a rear end of cargo area 16 and a rear concave surface 36 that defines a cup 24. The exterior surface 50 of body 12 at bulkhead 22 may include a circumferential driving band seat 38.

A keyway 40 may be defined in inner surface 20 of body 12 in cargo area 16. A circumferential slipped obturator seat 42 may be located on exterior surface of base 28 rearward of driving band seat 38. Obturator seat 42 may include an area of decreased outer diameter, compared to the outside diameter of base 28 forward of obturator seat 42.

The diameter of the bulkhead in the band seating location is approximately 6 inches of solid steel in a typical example of a 155 mm sizing of this invention. Exterior surface 50 of body 12 from cargo retaining ring 18 to the forward portion of bulkhead 22 may be smooth. That is, surface 50 from cargo retaining ring 18 to the forward portion of bulkhead 22 may be free of discontinuities. The wall thickness of body 12 from cargo retaining ring 18 to bulkhead 22 may be, for example, in a range of about 0.20 inches to about 0.75 inches. In a narrower range, the wall thickness of body 12 from cargo retaining ring 18 to bulkhead 22 may be, for example, in a range of about 0.25 inches to about 0.625 inches.

RTP 10 may have mechanical properties and a profile that may reduce the transition forces that soft catch systems impart to projectiles. The mechanical properties and shape of RTP 10 may allow cargo in RTP 10 to experience reactions that closely represent a live firing scenario. The modal frequency response of the RTP cargo may closely represent live fire dynamics.

When sized as a 155 mm projectile, RTP 10 may reliably handle base pressures up to approximately 71,000 psi. Other cargo rounds may only reliably handle base pressures up to approximately 61,500 psi. Base pressure is the amount of pressure exerted on the projectile during gun launch. RTP 10 may be reused if subjected to base pressures at or below approximately 71,000 psi. Other cargo projectiles may only be shot one time, at or below approximately 61,500 psi. It should be appreciated that the projectile must also survive extreme temperatures; the projectile sees around 1600 degrees Centigrade in the soft catch system, while the temperature of the combustion gases inside the gun chamber is about 2370 degrees Kelvin for PXR charges, e.g.

Concave cup 24 may reduce stress, compared to a flat surface. The concave shape of cup 24 (rear surface 36 of bulkhead 22) may direct the load paths of propellant gases proportionally into the walls around the cargo area 16 and into the cargo area 16. By doing so, the inertial loading from cargo 44 and the forces due to the gun gases may equalize each other lowering the stress tensor in the bulkhead. This equalization may apply a more uniform load throughout RTP 10. The lack of stress concentrations in the load path of RTP 10 and the smooth transitions in RTP 10 may contribute to its survivability and/or reusability.

Figure 6:
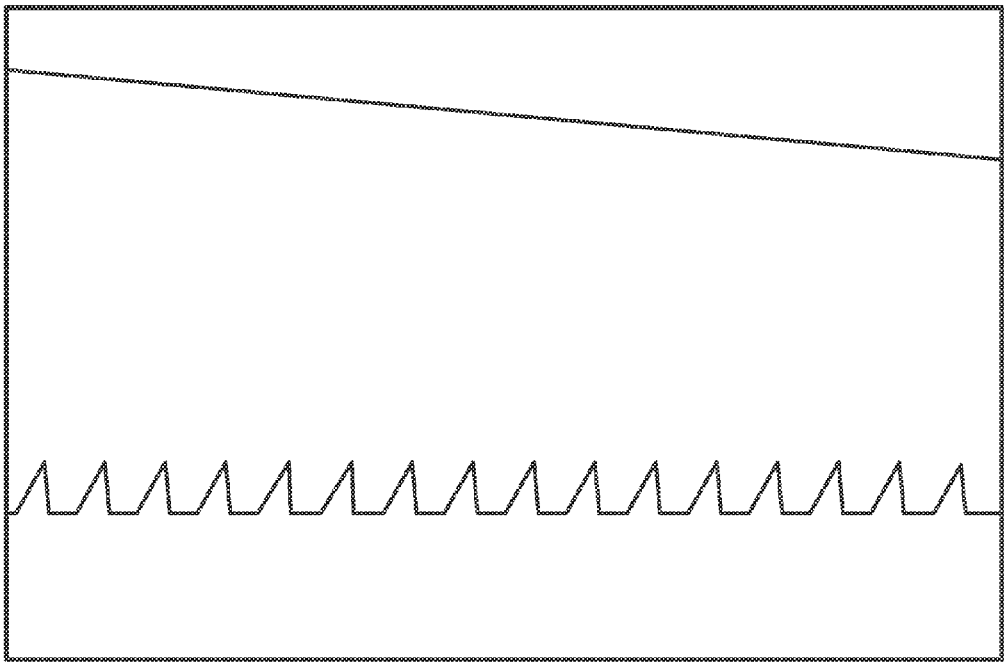
FIG. 6 is a side view of the custom buttressing design for the retaining ring threading.
Figure 7:
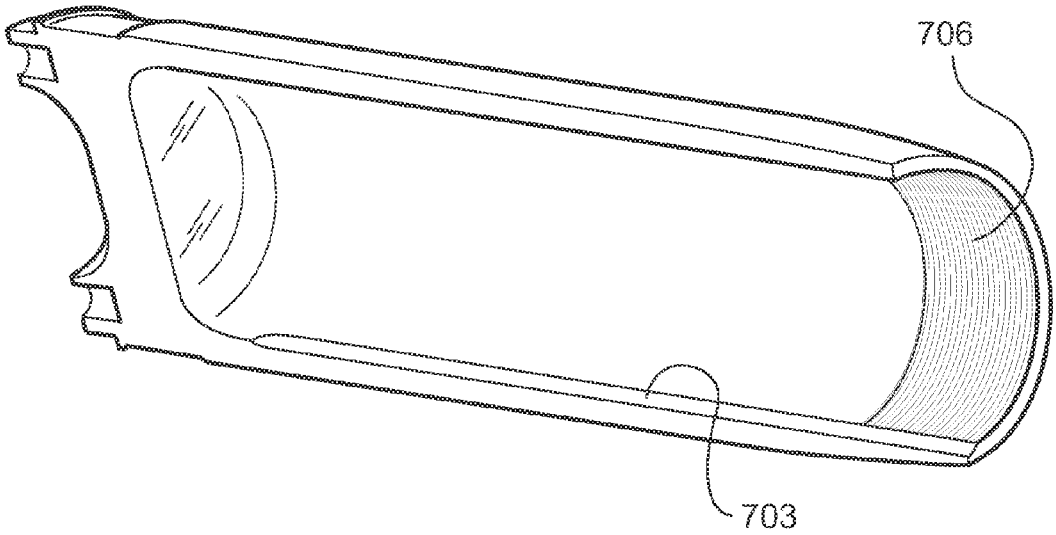
FIG. 7 is a partial cut isometric view of a reusable test projectile, showing retaining ring threading 706 and elongated keyway 703.
Figure 8:
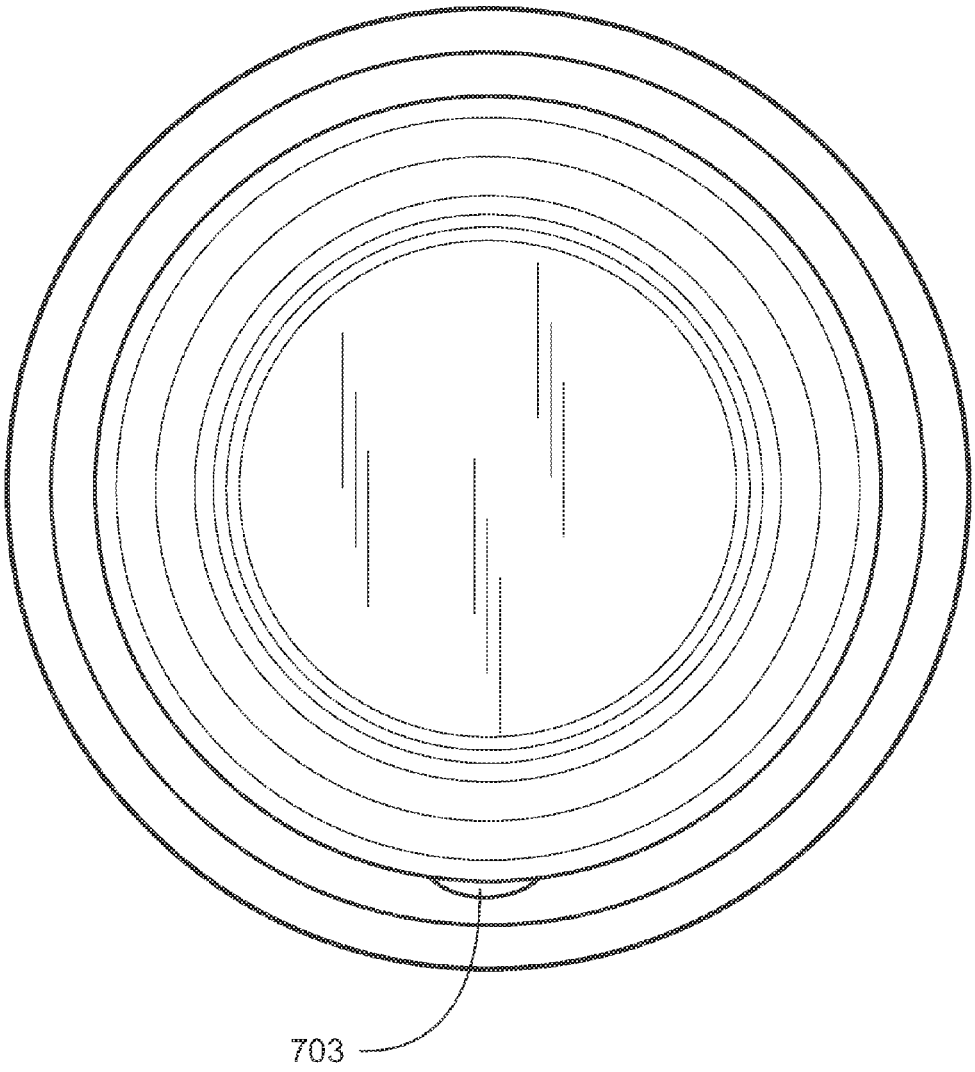
FIG. 8 is a side view of the reusable test projectile showing the half moon like cross sectional shape of keyway 703.

Cargo 44 may be disposed in the cargo area 16. Cargo 44 may be coupled to body 12. Cargo 44 may be keyed to keyway 40 in cargo area 16 such that cargo 44 may spin with body 12. The keyway is shown further in FIGS. 7 and 8 hereof. Cargo retaining ring 18 may be positioned to prevent axial movement of cargo 44 in cargo area 16. Cargo retaining ring 18 may threadingly engage inner surface 20 of body 12. The custom buttressing for such threading is shown in FIG. 6 of this application with the right side end of the sketch facing towards the ogive or front of the projectile. Such buttressing allows 27 lbs of cargo to withstand 5,000 G's of set forward and 20,000 G's of set back forces. Cargo 44 may have a sliding fit with inner surface 20 of body 12. The fit could be made to be within a ten thousandth of an inch. The inside diameter S of cargo area 44 may vary no more than, for example, 0.005 inches.

To ensure a smooth transfer of forces between front surface 34 of bulkhead 22 and cargo 44, a cargo shim 52 may be disposed between cargo 44 and front surface 34. Cargo shim 52 may have a rear surface 54 with a profile that mates with, attaches to, or matches the profile of front surface 34 of bulkhead 22 but is not required to compress the cargo stack. A spinning RTP 10 with spinning cargo 44 may be fired up to approximately 71,000 psi and may satisfactorily absorb the inertial torque applied to RTP 10 by its cargo 44. The keyway extends the whole inside length of the round. It has a cross-sectional shape where a half-moon like part of it is embedded into the side wall of the round's inside surface, and can partly extend into the cargo area, and is meant to engage with the cargo that will be placed there so the cargo can turn joined or at least together with the round. The half-moon shape has advantages for more seamless connection to the inside of the round than would, for example, a rectangularly cross sectional shape keyway. The rest of the keyway part could also be an (inverted and symmetrical) half-moon shape so that together the cross section would roughly look elliptical in form, or some other shape. It is also possible to have a plurality of like keyways.

As an alternative to cargo retaining ring 18, a threaded stud (not shown) may be fixed to front surface 34 of bulkhead 22.

Cargo 44 may include a threaded opening so that cargo 44 may be threaded onto the stud on the front surface 34 of bulkhead 22. In this way, cargo 44 may be secured without cargo retaining ring 18.

In RTP 10, ogive or nose 14 may load the walls of body 12, without loading cargo 44. Nose 14 may include or be replaced by, for example, an onboard recording device, other cargo, fuzes, guidance and navigation units or other projectile components or assemblies. Openings 56 may be formed in the front end of nose 14 for threading nose 14 on and off of body 12.

Figure 3:
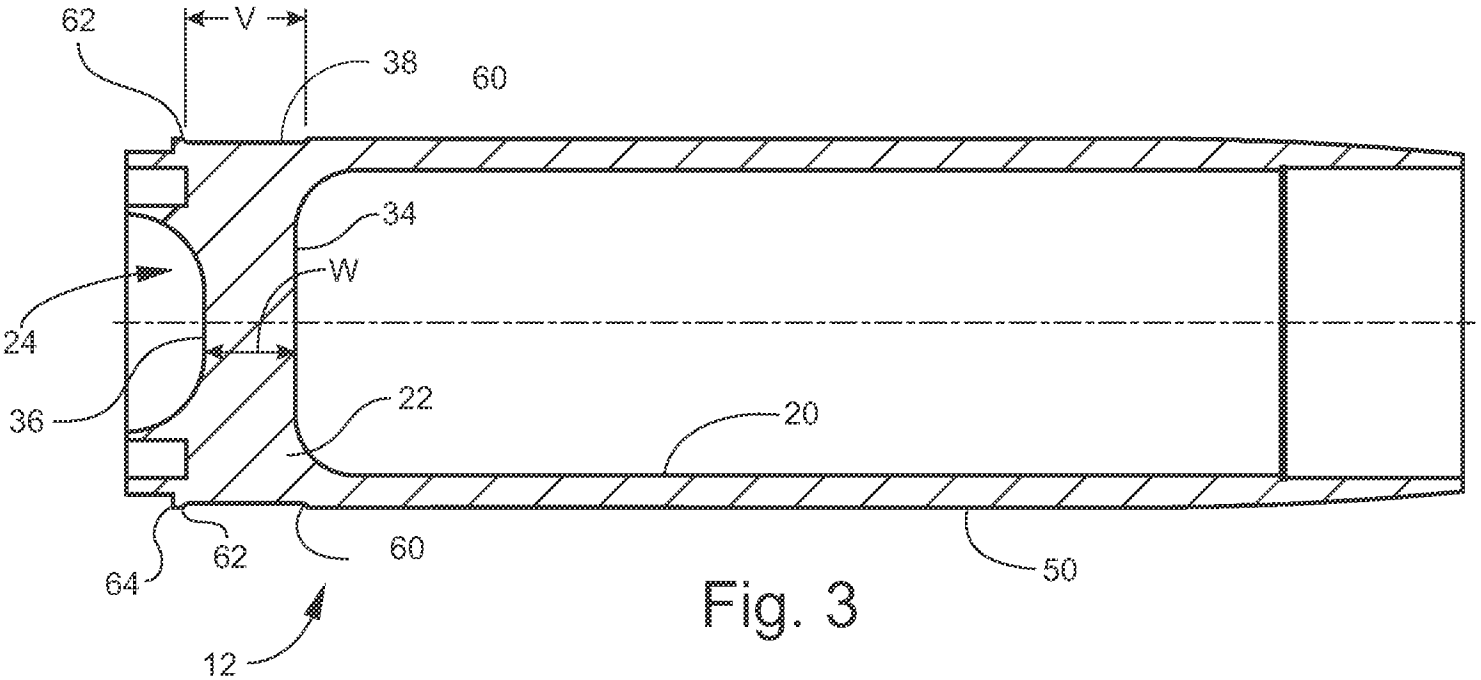
FIG. 3 is a side sectional view of a body of a reusable test projectile.

FIG. 3 is a side sectional view of body 12. The minimum axial width W of bulkhead 22 may be at least sixty percent of the axial width V of driving band seat 38. Or, the minimum axial width W of bulkhead 22 may be at least seventy percent of the axial width V of driving band seat 38. Further, the minimum axial width W of bulkhead 22 may be at least eighty percent or more of the axial width V of driving band seat 38. In one embodiment, bulkhead 22 may have a thickness W of, for example, about 1.5 inches, and driving band seat 38 may have a width V of, for example, about 1.8 inches.

As seen in FIG. 3, the outside diameter of body 12 may decrease at a front end 60 of driving band seat 38 and then may increase at a rear end 62 of driving band seat 38. A metal driving band 46 (FIG. 1) may be fixed to driving band seat 38. Because of the placement and size of bulkhead 22 in RTP 10, a very large metal driving band 46 may be welded to RIP body 12. Metal driving band 46 may comprise copper, for example. Cracking of RTP body 12 due to welding driving band 46 in place may be less likely because of the large size of bulkhead 22 and the lack of stress concentrations under driving band 46 or around driving band 46. The large volume of metal in bulkhead 22 may act as a heat sink. Many prior projectiles have very thin walls that may result in stress concentrations or material gradients in physical properties underneath their driving bands.

Because of the placement of bulkhead 22 and large driving band seat 38, driving band 46 may, as an alternative to welding, be swaged on body 12. Swaging is a mechanical process that uses large amounts of pressure to mechanically couple driving band 46 to body 12 through staking and interference.

A swaged band 46 axially and torsionally coupled to the body 12 but not cohesively coupled to the band seat 38 in the normal direction of the band seat 38 may be designed to discard upon muzzle exit using the centrifugal force of spinning and the bands mass to ripe the band 46 apart from the high hoop stresses induced in the band 46 by the centrifugal forces. If body 12 were hollow at the area of driving band seat 38, the amount of force used to swage driving band 46 on body 12 might collapse body 12, unless body 12 were supported in some way.

The force required to swage a band on a body may be directly proportional to the size of the band. A narrow band requires less force, while a wider band requires more force. Thus, multiple band geometries (wide to narrow) may be applied to RTP 10 with welding, swaging, or other processes. Only small bands may be swaged onto hollow projectiles, unless additional support is provided.

Because of the large size of bulkhead 22, RTP 10 may be fired through a band cutter, which may strip driving band 46 off RTP 10. The band cutter mechanically machines band 46 off in a known manner, like a pencil sharpener. The RTP bulkhead 22 may reduce flex of body 12 as it passes through the band cutter.

Figure 4:
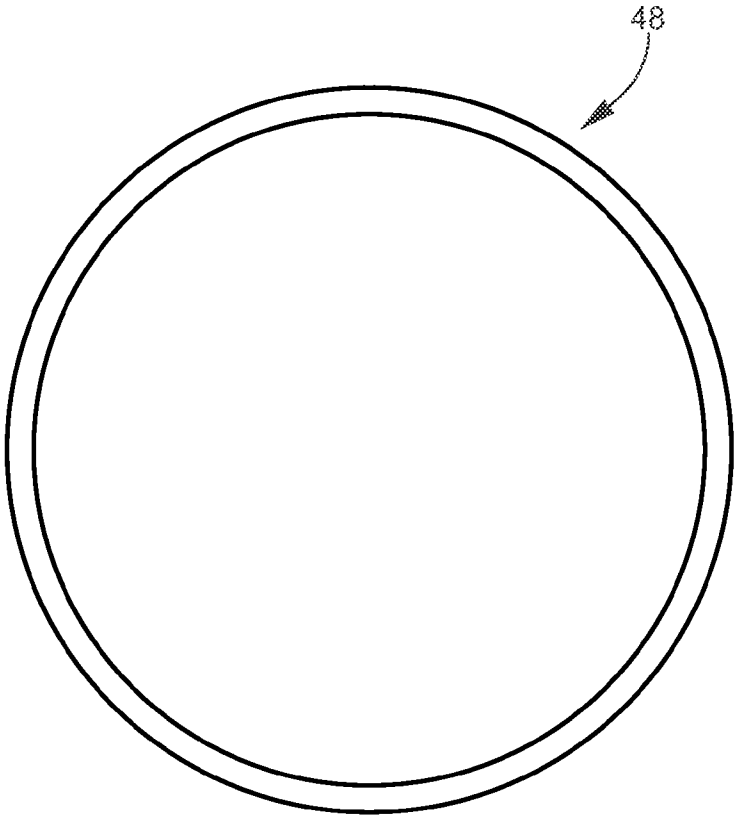
FIG. 4 is a schematic diagram of a slipped obturator for a reusable test projectile.
Figure 5:
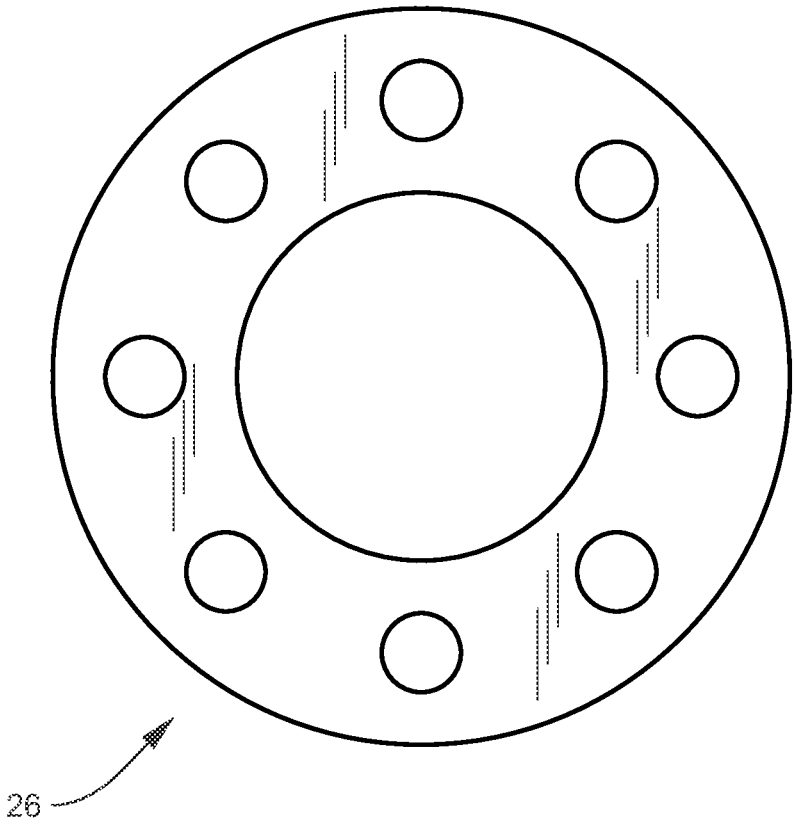
FIG. 5 is a front view of an embodiment of an obturator retaining ring for a reusable test projectile.

After driving band 46 is stripped or discarded, RTP 10 may be fired as a non-spinning round. RTP 10 may include the features needed to attach a slipped obturator and RTP body 12 may be designed for slipped obturator loading. A slipped obturator 48, shown schematically in FIG. 4, may be disposed at slipped obturator seat 42. A slipped obturator retaining ring 26 (FIGS. 1 and 5) may be removably fixed to a rear end of base 28 using, for example, threaded fasteners 58. As shown in FIG. 3, the outside diameter of body 12 may decrease at the front end 64 of slipped obturator seat 42.

Or, after driving band 46 is stripped from RTP 10, another driving band 46 may be welded to RTP 10 and RTP 10 may again be fired as a spinning round. Repeated firing as a spinning round is possible because the heat affected zone from welding driving band 46 may be outside the critical load path in RTP 10.

RTP 10 may be used not only to test cargo. Different types of slipped obturators 48 may be installed and tested on RTP 10. RTP 10 may not fail if subjected to the blow-by loads seen during catastrophic slipped obturator failure (maximum pressure applied to the side of the projectile). The combination of the material of construction of RTP 10 and its wall thickness results in a projectile that may withstand the pressure of propellant gases that may escape by the slipped obturator and apply pressure to the projectile wall. The ability to withstand the blow-by pressure is important because, if a projectile subjected to blow-by from a catastrophic slipped obturator were to fail, the projectile may partially implode while inside the gun bore. Implosion of the projectile in the gun bore may ruin the gun and may injure nearby personnel.

RTP 10 may also be used to test projectile components including finned bases, base bleeds or rocket motors. If the projectile components desired to be attached to the RTP 10 do not have the feature necessary to attached to rear end of base 28 using, for example, threaded fasteners 58, the RTP 10 is designed to allow slipped obturator seat 42 to be modified with a thread to allow projectile components to be threaded onto the rear end of base 28.

RTP 10 may be designed to carry cargo, but not expel cargo. Other munition cargo carriers may have a hollow body, base, and nose. Either the base or the nose of other projectiles must be removed to expel the cargo. In RTP 10, the cargo is not expelled, but is recovered from RTP 10 and examined. So, RTP 10 may have a unified or integral base 28 and body 12. RTP 10 may have a unified nose or ogive 14 and body 12, if desired. Base 28 and body 12 may be forged from a single piece of stock. Other cargo rounds may have separate bases, bodies, and noses.

RTP 10 may accept a slipped obturator 48 (FIG. 4) (non-spinning configuration) or a copper driving band 46 (FIG. 1) (spinning configuration). A spin rate of 10-50 Hz would be a simulation of a fin stabilized round (basically little or no appreciable spin) whereas a spin rate of perhaps 300 Hz could be a simulation of a spin stabilized round. RTP 10 may be fired in either the spinning or non-spinning configuration into a soft catch system. Tactically, RTP 10 may be fired in the spinning configuration with no additional hardware. If a fin kit were bolted to RTP 10, RTP 10 may be fired as a tactical non-spinning fin-stabilized round, if propelled by a slipped obturator and a fin stabilizing base attached to the rear end of base 28.

RTP 10 may have a per shot cost of about $20. Per shot cost is the life cycle cost of the projectile divided by the number of shots it can be fired.

RTP 10 may also be loaded with high explosives and used as a tactical round. Thus, RTP 10 may be used as a test asset or a tactical asset, if desired.

Critical crack size is the size of a crack in the wall of a projectile that will cause failure of the projectile. A crack that is larger than the critical crack size will cause failure and a crack that is smaller than the critical crack size will not cause failure. In RTP 10, the critical crack size is visible to the unaided human eye.

All projectiles in production may be built to survive interior ballistic (gun loads) loads, fly straight, and exhibit terminal ballistic effects. Because external and terminal ballistic effects drive the design of nearly all projectiles, tactical projectiles are not solely optimized for interior ballistic (gun loads) loads. Using a soft catch system, RTP 10 may only be subjected to interior ballistic loads. Thus, RTP 10 may withstand greater interior ballistic loads and may maximize cargo volume. Though RTP 10 may not be optimized for general terminal ballistic effects, if loaded with a high explosive train, RTP 10 may generate significant terminal ballistic effects.

Fatigue analysis shows that RTP 10 may survive one PMP+25% spinning shot and ten to fifty PMP+25% non-spinning shots before the fatigue life of RTP 10 may be reached. Depending on the number of test projectiles used, the dollar savings by using RTP 10 may be in the millions. Generally the ratio (~1:50) of the number of spinning shots required to the number of non-spinning shots required is low.

A finite element analysis was performed for RTP 10. The peak stress for the RTP 10 was 152,500 psi. In addition, the stress profile for RTP 10 gradually increased from the nose 14 to the base 28.

Material that does not carry load may be a waste of limited space. In the area of base 28 of RTP 10, however there are only very small areas of low loading (low stress). Thus, virtually all the material of the RTP 10 helps to support load, which is an efficient use of its RTP 10 showed almost a constant stress near the rear of body 12 and throughout bulkhead 22. The lack of stress concentrations in RTP 10 may allow RTP 10 to be loaded to extremes pressure limits (PMP+25%). Bulkhead 22 of RTP 10 may help to distribute the pressure loading that base 28 may experience during gun launch, and may help distribute the opposing inertial loading of cargo 44. Bulkhead 22 may create an almost uniform stress distribution.

The RTP 10 may be used for a variety of calibers. In one embodiment, RTP may be a 155 mm projectile. As new soft catch systems are built, other calibers of RTPs may be used.

A few comments are made here with regard to an M483 cargo round. It has a relatively thin body all around (some 0.375 of an inch). Heating it to weld driving bands can crack the round. Putting pressure on the body to swage on a driving band could crush the body. So, refurbishing for serial flights would not seem possible. The (generally aluminum) base seems only able to withstand about 40,000 psi of pressure before it deforms (and certainly less than 61,500 psi of pressure), making it seem unsuitable in cases where 71,000 psi of pressure are needed, e.g, to be withstood. It was designed for 8,000 G's of setback of forces to be withstood. The material is generally 1340 steel, of only about a 145 ksi yield. So again, reuse for proposed serial flights would not seem possible. In any case, no front loading of cargo, e.g., could ever be possible. Further, loading, if attempted, would have to be by unscrewing the base, attaching cargo, then re-screwing the base. In such use it must be noted, the base would lock tight as it turns shut during a proposed flight, making it impossible to open and then re-use, according to its existing design. If proposed loading were attempted, the cargo area length would be only be of a fixed length—only generally up to the (formerly placed) pusher plate location and custom shims or the like would be needed to attempt to secure such cargo which would require tailored packing each flight and would also waste considerable time. Cargo fit if even possible, would not be compact, (only 15-20 thousandths of an inch tolerance) so balloting can result. Its keyway only extends about a quarter of the distance into the length of the cargo, and the cross-sectional shape of the keyway is only rectangular which has stress concentration in the corners.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A front loaded reusable test projectile (RTP) for use in a soft catch recovery system, comprising:

a single piece projectile body having a generally cylindrical body portion defining an inner surface and a generally cylindrical open area, a base region at an aft end of the body portion and having an aft solid bulkhead with a solid diameter, the bulkhead defining a rear concave surface and a frontal recessed area, and a longitudinal axis passing through the body portion and the base region;

a removable nose attached to the body portion at a forward end thereof and selectively closing the cylindrical open area, wherein said cylindrical open area is located between the nose and the bulkhead and defines a cargo area, and wherein said RTP is configured be front loaded with cargo into said cargo area by removing the removable nose to open the cylindrical open area;

a circular cargo retaining ring disposed in the cylindrical open area and normal to the longitudinal axis, an outer surface of the cargo retaining ring engaging an inner surface of the body with a buttress threading, the cargo retaining ring being adjustable in an axial direction;

a metal shim seated inside the frontal recessed area of the bulkhead and forming an essentially right cylindrical area for cargo to rest into;

at least one keyway defined in the inner surface of the body portion, said at least one keyway running substantially the entire length of the projectile body and having a half-moon or elliptical cross-section, the at least one keyway being keyed to cargo in the cargo area such that the cargo can spin with the projectile, the cargo having a sliding fit with the inner surface of the body portion;

a slipped obturator seat indentation formed on an exterior surface of the projectile body, a slipped obturator disposed in the slipped obturator seat, and a slipped obturator retaining ring removably fixed to an aft end of the base region, wherein a new slipped obturator may be placed in the slipped obturator seat and a new slipped retaining ring may be emplaced at said aft end of the base region, after the RTP has been launched and recovered, in order to prepare the RTP for re-launch; and a driving band seat indentation formed on the exterior surface of the projectile body at an axial location where the longitudinal axis intersects with the bulkhead, between the nose and slipped obturator seat indentation, the driving band seat indentation being configured to seat a metal driving band on the projectile body to interact with rifling in a barrel during launch of the RTP, and wherein a new metal driving band may be newly swaged, welded onto, or shrunk onto the projectile in the driving band seat indentation, after the RTP has been launched and recovered, in order to prepare the RTP for re-launch.

2. The projectile of claim 1, wherein a minimum axial width of the bulkhead is at least sixty percent of an axial width of the driving band seat.

3. The projectile of claim 1, wherein the minimum axial width of the bulkhead is at least seventy percent of the axial width of the driving band seat.

4. The projectile of claim 1, wherein inside diameters of the cargo area vary no more than 0.005 inches.

5. The projectile of claim 1, wherein a wall thickness of the body from the cargo retaining ring to the front end of the driving band seat is in a range of about 0.10 inches to about 0.75 inches.

6. The projectile of claim 1, wherein the nose includes an onboard recording device.

7. The projectile of claim 1 wherein the projectile body is made of 4340 steel material.

8. The projectile of claim 1 wherein the bulkhead's diameter is approximately six inches.

9. The projectile of claim 1 wherein said cargo is comprised of two or more sections, one section positioned behind the other.

10. The projectile of claim 1 wherein the metal shim is of aluminum.

11. The projectile of claim 1 wherein the nose is adapted to include the guidance and navigation unit, or the fuze, from a different round for testing purposes.

12. The projectile of claim 1 wherein the base is adapted to include the base, base bleed or rocket motor assembly, from a different round for testing purposes.

* * * * *